US005100117A

United States Patent [19]

Hajek et al.

[11] Patent Number: 5,100,117

[45] Date of Patent: Mar. 31, 1992

[54] WEB GUIDING SYSTEM, PARTICULARLY TURNING BAR SYSTEM FOR SUPERPOSING SLIT PAPER WEBS RECEIVED FROM A WEB-FED ROTARY PRINTING MACHINE

[75] Inventors: Josef Hajek, Friedberg; Norbert Grimm, Augsburg, both of Fed. Rep. of Germany

[73] Assignee: Man Roland Druckmaschinen AG, Offenbach am Main, Fed. Rep. of Germany

[21] Appl. No.: 680,166

[22] Filed: Apr. 3, 1991

[30] Foreign Application Priority Data

Apr. 26, 1990 [DE] Fed. Rep. of Germany ..... 4013229

[51] Int. Cl.[5] ..... B65H 39/00

[52] U.S. Cl. ..... 270/52; 270/18; 226/197; 226/199

[58] Field of Search ..... 270/52, 18, 43; 226/197, 199

[56] References Cited

U.S. PATENT DOCUMENTS

| | | | |
|---|---|---|---|
| 1,374,196 | 4/1921 | Getches | 226/197 |
| 2,284,318 | 5/1942 | Hamlin | 226/197 |
| 3,399,884 | 9/1968 | Bahrani | 270/52 |
| 3,623,645 | 11/1971 | Klingler | 226/199 |
| 3,809,303 | 5/1974 | Brunner | 226/197 |
| 4,043,495 | 8/1977 | Sander | 226/197 |
| 5,016,801 | 5/1991 | Gilat | 226/197 |

FOREIGN PATENT DOCUMENTS

| | | | |
|---|---|---|---|
| 1791899 | 12/1971 | Fed. Rep. of Germany . | |
| 2920684 | 11/1980 | Fed. Rep. of Germany . | |
| 3131621 | 6/1982 | Fed. Rep. of Germany . | |
| 3436870 | 5/1986 | Fed. Rep. of Germany . | |
| 3816900 | 11/1989 | Fed. Rep. of Germany . | |
| 788970 | 10/1935 | France . | |
| 280782 | 11/1927 | United Kingdom | 226/197 |

OTHER PUBLICATIONS

Der Tiefdruck A. Braun, Polygraph Verlag GmbH Frankfurt/Main 1952, pp. 193–197.

*Primary Examiner*—Edward K. Look
*Assistant Examiner*—Therese M. Newholm
*Attorney, Agent, or Firm*—Frishauf, Holtz, Goodman & Woodward

[57] ABSTRACT

To selectively place web portions slit from a printed paper web with a left web portion above a right one over a right web portion above the left one, the parallel-arriving web portions are so guided through a turning bar looping of the right or left web about the turning bars, with superposition, which involves a 90° position change of the turning bars, and while maintaining the air cushion between the paper web and the turning bars, the level of the arriving web with respect to the first-encountered or passed over or looped about turning bar is controlled or so set that the web will engage the turning bar tangentially with the plane of the arriving web portion and delivery web portion parallel to each other, by, respectively, guiding the web portion either above the turning bar pair or from below the turning bar pair, upon 90° shift of the turning bar pair. The respective height guidance can be done by either first guiding the arriving web portion in the appropriate direction or by positioning the level of the turning bars of the turning bar pair to meet the arriving web portion in accordance with the desired looping direction of the arriving web portion about the pair of turning bars.

9 Claims, 6 Drawing Sheets

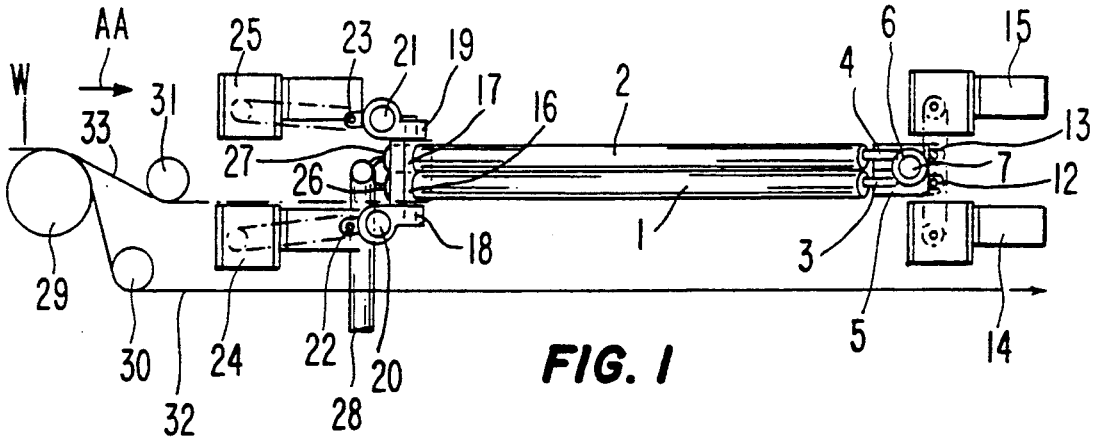
FIG. 1
FIG. 2
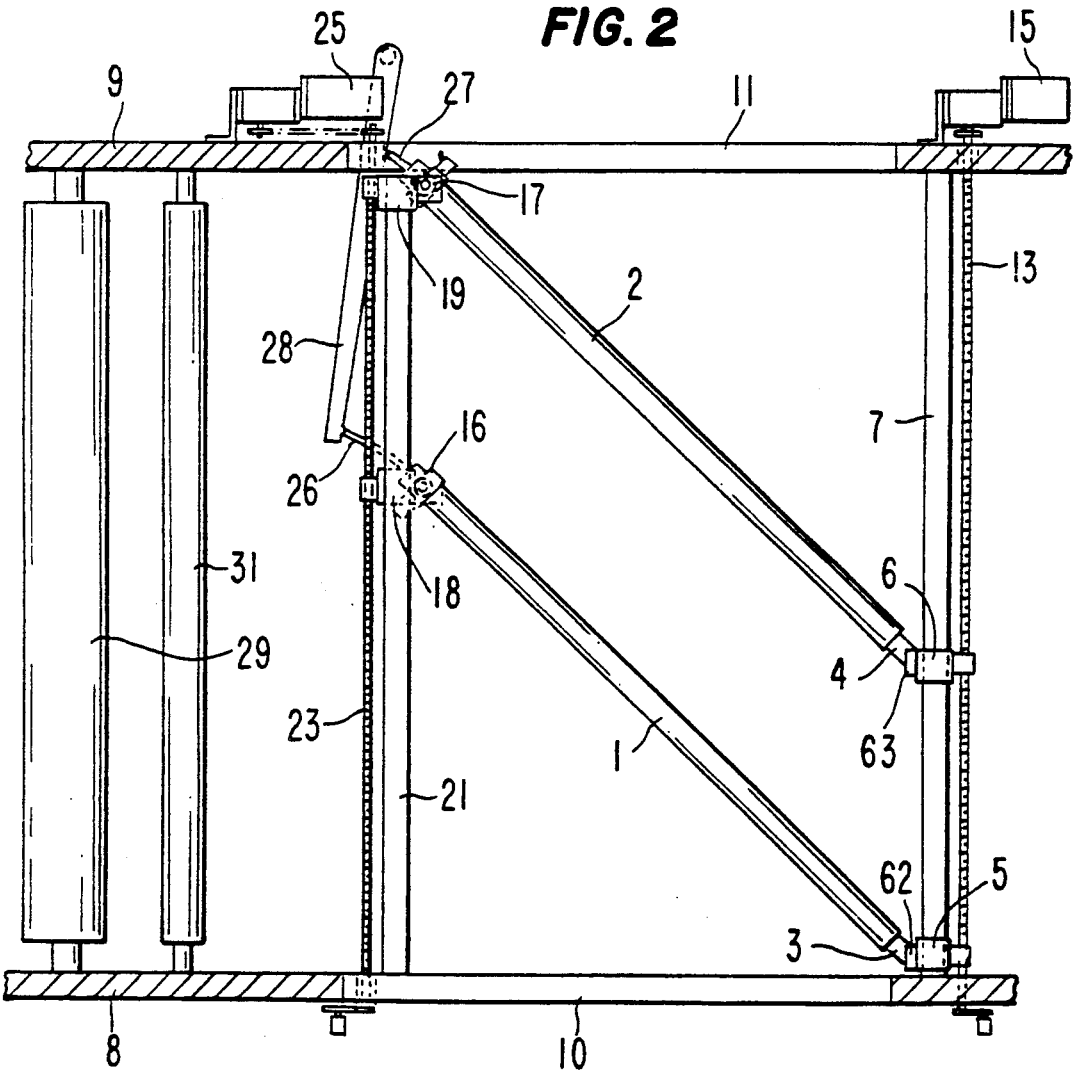

FIG. 4
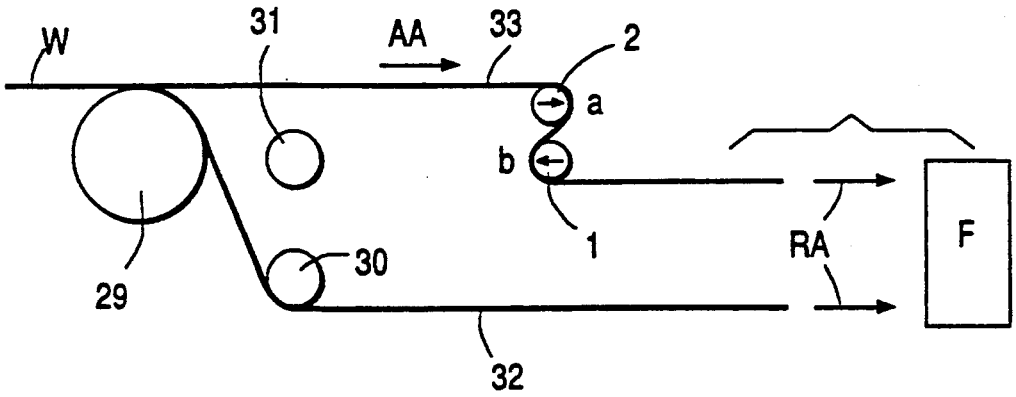
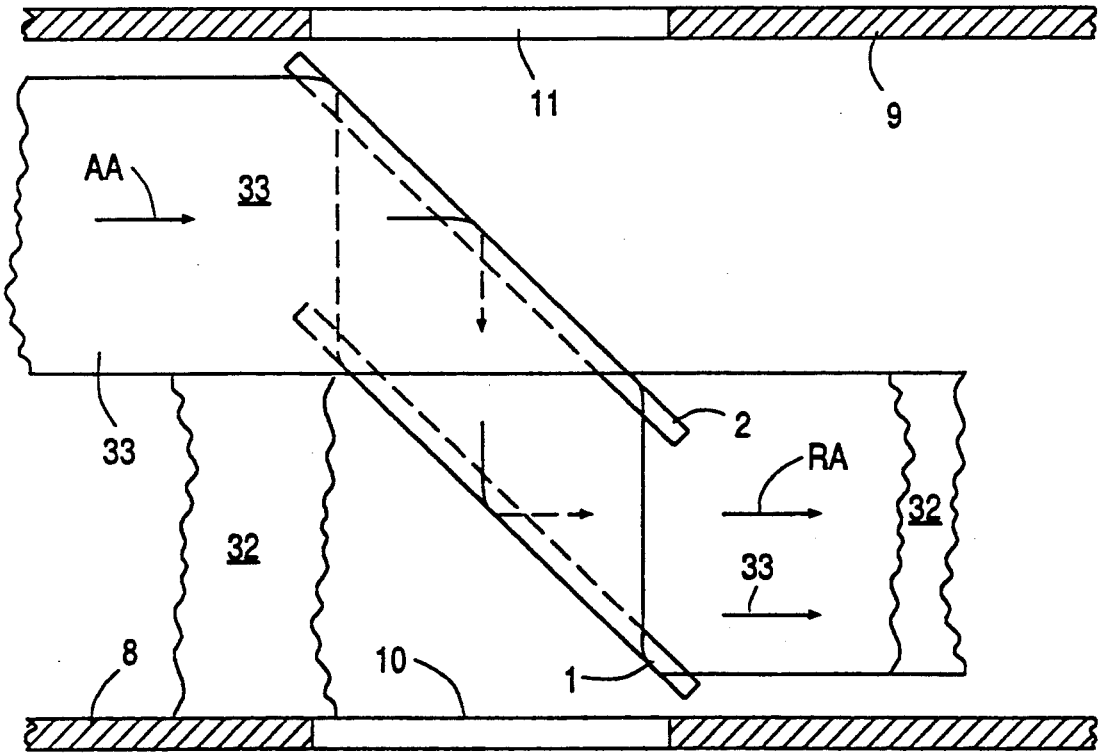
FIG. 3

FIG. 6
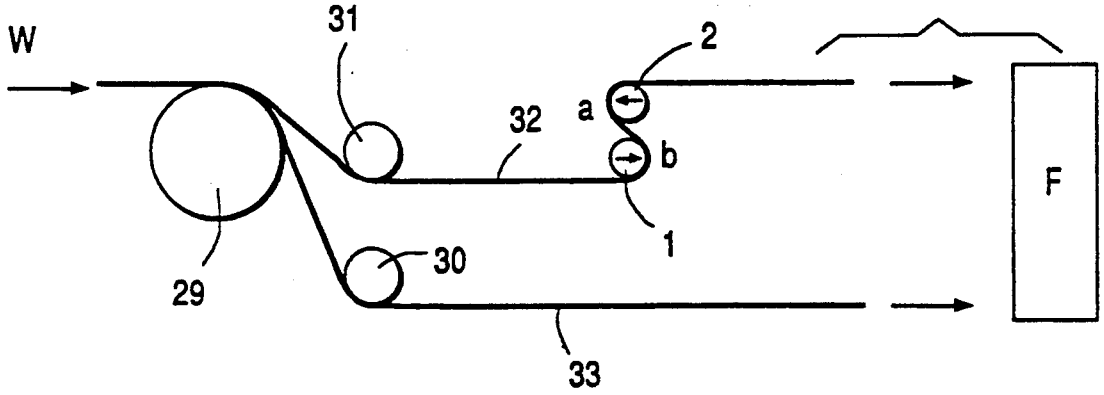
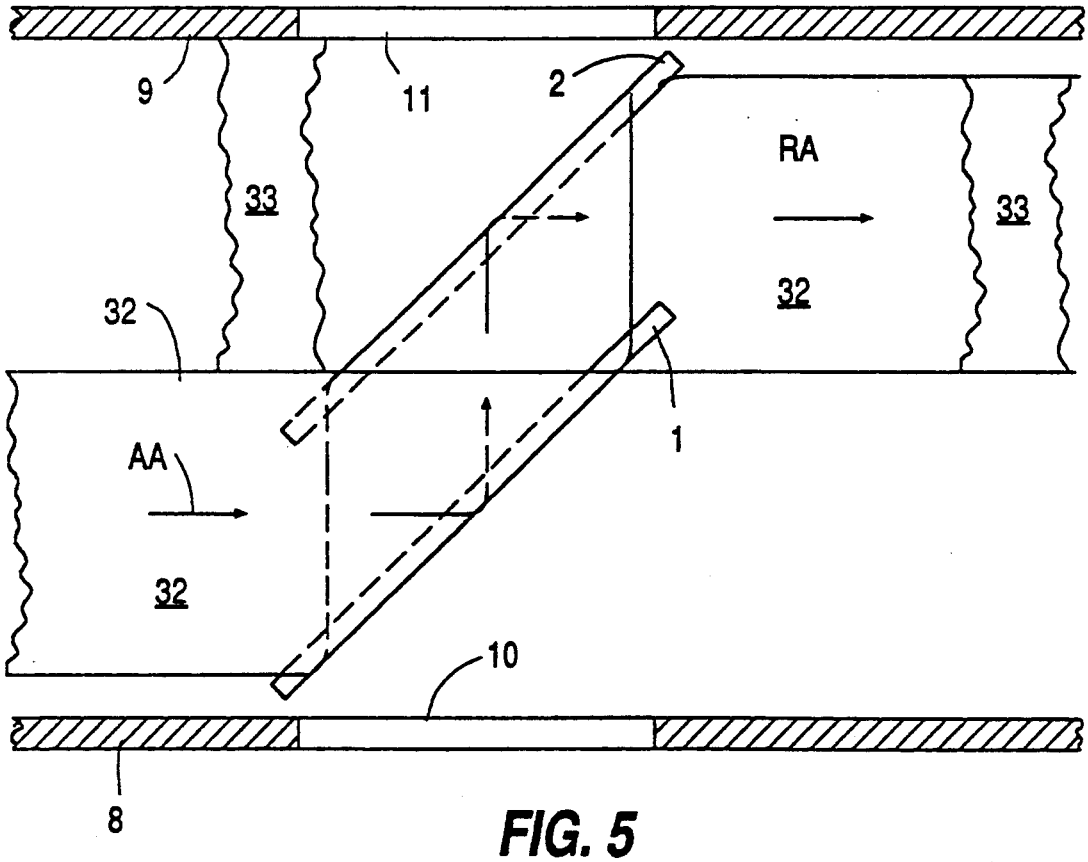
FIG. 5

WEB GUIDING SYSTEM, PARTICULARLY TURNING BAR SYSTEM FOR SUPERPOSING SLIT PAPER WEBS RECEIVED FROM A WEB-FED ROTARY PRINTING MACHINE

FIELD OF THE INVENTION

The present invention relates to web handling, and more particularly to place a web portion arriving in parallel to another web portion, selectively, over or beneath the parallel web portion. Such systems are used frequently in combination with rotary web-fed printing machines in which a paper web is slit longitudinally. The resulting slit web portions then are guided to be superposed one above the other. The present invention is specifically directed to selectively placing, for example, a web portion arriving at the right of another web portion, selectively, above or below the other web portion.

BACKGROUND

Apparatus to place a web portion, selectively, above or below another web portion are well known, and usually uses vertically staggered turning bars, which can be rotated in pairs by 90°. These turning bars, for smooth and low wear handling, are formed with perforations or exit openings for air jets at the side about which the web is looped, so that the web, effectively, can be supported by a thin air cushion.

Turning bar systems can be used, for example, when one web portion is to be guided beneath the turning bars, without turning-over or otherwise changing its path for further application to a folding apparatus. The other web portion is guided over the turning bars so that it will be in alignment and stacked over or superposed on the first web portion.

It may occur that production changes require that the previously deflected web portion is to pass straight through the system, whereas the previously deflected turning bar is to be deflected.

Different, selective use of the turning bar system introduces a problem, namely that, upon changing the relative paths of the web portions, the exit openings for the air blasts, upon change-over, will no longer be on the side of the turning bar about which the web is looped. In order to ensure that the web will be supported by an air cushion, it is then necessary to remove the turning bars or turning bar tubes from their holders, turn them about their axes by 180°, and then, after resetting the turning bar tubes 90° changed in orientation with respect to the previous setting, that is, rotated 90° about an axis perpendicular to the longitudinal axis of the tube, to re-assemble the turning bar tubes, together with the air supply. This is complicated, takes time, is very labor-intensive, and can only be carried out by hand by operators. Change of the orientation of the—hollow—turning bars by 90° rotation about their vertical axis, thus, cannot be merely automatically commanded, for example from a remote control command console; manual rotation of the turning bars about their longitudinal axis is, additionally, necessary.

THE INVENTION

It is an object to improve a web guiding system, and more particularly a hollow turning bar system with an air cushion for the web, so that the turning bars can be rotated by 90° about an axis perpendicular to their longitudinal axis, to permit change-over of the relative position of two web portions, while retaining the openings or apertures for the air cushion at the side about which the respective web portion is passed or looped.

Briefly, the system includes an arrangement to ensure the presence of an air cushion between the turning bar and one of the web portion regardless of the position of the turning bar, that is, its orientation with respect to the direction of movement of the web. The arrangement provides a guide or web travel path control arrangement for the web portion passed over the turning bars including a web supply roller which, at the same time, can slit the web into the two portions and a web portion guide roller. The web, thus, can, selectively, be looped from below or from above the turning bars, that is, the path of travel with respect to the level of the turning bars and direction of the looping path about the turning bars can be controlled as desired.

Control of the path of travel can be done, for example, by the guide roller which suitably guides the web to the first turning bar of a pair either from above and then below the second turning bar of the pair, in an S-shaped path; or, to guide the webfirst so the re-positioned second turning bar from below and then in an S-shaped path upwardly over the previously first turning bar. In an alternative arrangement, the turning bars are movable so that they, respectively, align themselves with respect to the path of travel of the respectively arriving web portion, that is, to receive the arriving web portion above the first turning bar of the pair or from below the second turning bar of the pair.

The present invention, thus, provides for a path change upon rotation of the turning bars about an axis perpendicular to their longitudinal axis if the relative web portion positions are to be interchanged, in that the turning bars of the pair interchange their function when the relative web portion position is to be changed, by interchanging the arriving and departing guide function of the web portion by the respective turning bars of the turning bar pair.

DRAWINGS

FIG. 1 is a side view of the turning bar system to guide web sections in a predetermined path, and illustrating a slitting cylinder or roller and paper guide elements;

FIG. 2 is a top view of the system of FIG. 1;

FIG. 3 is a schematic side view of the turning bar system according to FIG. 1, and illustrating the run of one of the web portions;

FIG. 4 is a highly schematic top view of the arrangement of FIG. 3;

FIG. 5 is a schematic side view of the turning bar arrangement as shown in FIG. 1, but shifted 90°;

FIG. 6 is a highly schematic top view of the arrangement of FIG. 5, and illustrating the changed web portion path;

DETAILED DESCRIPTION

Figure 7:
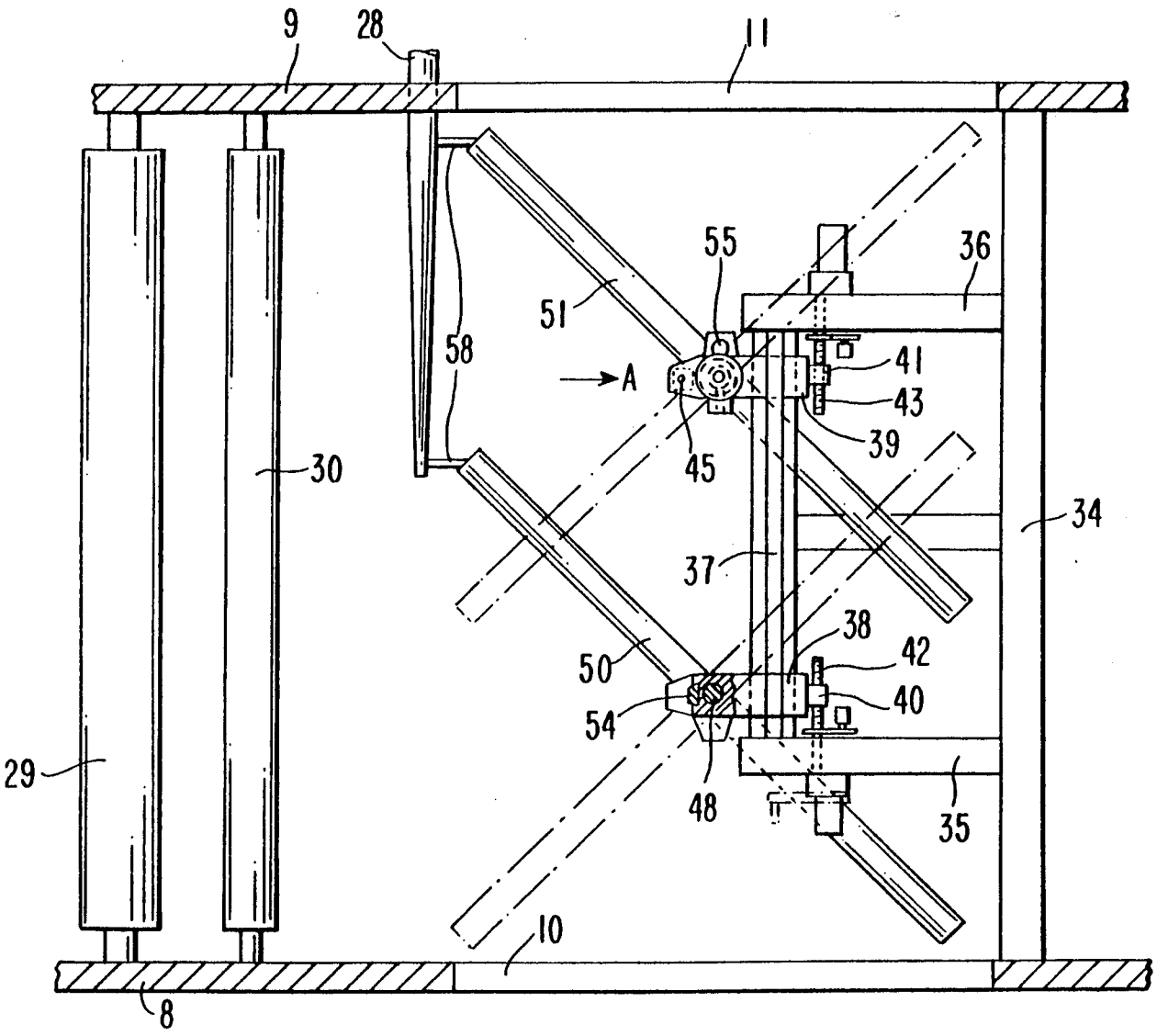
FIG. 7 is a top view illustrating flying retention of turning bars.

Referring first to FIGS. 1 and 2:

Two tubular turning bars 1, 2 are secured at one end, respectively, to head elements 3, 4. The head elements 3, 4 are pivotably attached to slit support or carrier elements 5, 6. Pins 62, 63 provide for pivotable connection of the head elements 3, 4 with the carrier elements 5, 6, so that the turning bars 1, 2 can pivot or rotate about the pins 62, 63. The carrier elements 5, 6 are longitudinally shiftable on a cross bar or cross element 7, retained at both ends in the side walls, or in frame elements 8, 9 of the turning bar apparatus, which can be part of a printing machine structure. The wall 8 is defined as the operating side and the wall 9 as the drive side, in accordance with customary nomenclature used in connection with printing machines. Both of the side walls 8, 9 have access window 10, 11 formed therein. The access windows define the space taken up by the turning bars 1, 2. Each turning bar support 5, 6 has a threaded spindle 12, 13 associated therewith. The longitudinal axes of the spindles 12, 13 extend parallel to the cross rod 7. Drive motors 14, 15, for example gear motor combinations, are coupled, respectively, to the spindles 12, 13 for rotating the spindles.

The other end of the turning bars 1, 2 is retained in a slide guide or bearing 16, 17. The slide bearings 16, 17 are rotatably located on a respective carrier element 18, 19. The carrier elements are axially shiftable on a cross element 20, 21. The axes of the cross elements 20, 21 are parallel, and located staggered above each other, with an axial spacing of at least twice the diameter of a turning bar 1, 2 so that, upon shifting position of the turning bars, the turning bars can pas between the cross elements 20, 21. Each one of the cross elements 20, 21 has a threaded spindle 22, 23 associated therewith, coupled, respectively, to a gear motor 24, 25. All motors are located on the drive side of the thereto. A flexible hose 26, 27 is fitted into the free end of the tubular turning bars. The flexible hoses 26, 27 are coupled to a rotatably located telescopic tube 28, secured to the wall 9. Compressed air can be coupled to the telescoping tube 28, to be ejected from apertures, such as holes or slits formed in the turning bars, to ensure good guidance and passage of of a web about the turning bars. These apertures are not visible in the drawings and can be made as well known in connection with turning bar systems.

FIGS. 1 and 2 further illustrate a cutting roller or cylinder 29. The running direction of the web W received, for example, from printing stations of a printing machine, is from left to right, as schematically shown by the arrow AA FIG. 1. The web W is guided by a guide means formed by the roller or cylinder 29 and by two paper guide and/or deflection rollers 30, 31 which are located between the side walls 8, 9, parallel to the cross elements 20, 21. They are vertically staggered, as best seen in FIG. 1.

When passing a web about the turning bars, it is necessary to prevent drift of the web as it is looped about the inclined turning bars. To prevent such drift, it is necessary that the web run tangentially to an uppermost or lowermost diametrical point or line of the angled turning bar of the pair and leaves the other angled turning bar, respectively, at a lowermost or uppermost point or line parallel to the plane of the arriving web.

The cutting roller 29 slits the web W into two web portions 32, 33.

FIG. 3 shows that the web portion 32 is guided by the lower guide and deflection roller 30 longitudinally beneath the turning bars 1 and 2, in a straight line, to a folding apparatus, not shown, and located, with respect to the running direction of the web, downstream of the run-out arrows RA. A second web portion is guided directly tangentially to the upper side of the turning bar 2. The cutting roller or slitting roller 29 is so positioned in the printing machine that the upper tangential surface of the cutting roller 29 and the upper tangential surface of the upper turning bar 2 are connected by the web portion 33 in precisely tangential, and in the example shown, horizontal direction. This tangential run-on of the web portion 33 is necessary to prevent drift, or lateral shifting of the web portion on the turning bars. The web portion 33, which is the left half of the web W, after slitting, is turned by turning bar 2 and again turned by turning bar 1, in an S-shaped path, see FIG. 4, and is guided tangentially from the lower side of the parallel turning bar 1 above the first web portion 32 to the folding apparatus schematically shown merely by the box F, and which may be of any standard and well known construction.

If it is desired to place the right web portion 32 above the left portion 33, it is necessary to re-position the turning bars 1, 2 of the turning bar pair by 90°.

Referring now to FIGS. 5 and 6, illustrating this modified or changed web path:

In accordance with a feature of the invention, not only are the turning bars repositioned but the function of the turning bars 1, 2 is reversed. In the illustration of FIGS. 3 and 4, bar 2 may be referred to as the angle turning bar, and bar 1 as the run-out or parallel bar. This function is reversed in FIGS. 5 and 6, in which bar 1 will be the angle turning bar and bar 2 the run-out or parallel bar. Since the two bars 1, 2 are vertically staggered, and to maintain the tangential run-on, run-off condition of the web portion about the turning bar pair, it is necessary to guide the web portion 33 to reach about the lower one of the turning bars, that is turning bar 1. To do so, the additional guide roller 31 is used, located at a level in alignment with the lowest diametrical point of the turning bar 1, as best seen in FIG. 6. This, then, also ensures that the outlet openings for blowing or compressed air in the hollow turning bar tubes 1, 2 will be at the same side in which the web portion is looped about the turning bar. In FIGS. 4 and 6, the outlet openings and their direction with respect to the turning bars are illustrated, schematically, by the arrows a, b. Comparing the position of the arrows a, b in FIG. 4 with the position of the arrows a, b in FIG. 6, it can be seen that although the turning bars have been reversed by 90° and the outlet opening re-directed by 180°, the web is still looped about the turning bars in such a manner that it will be supported by an air cushion. The direction of the air exits has been reversed without, however, affecting the function of the emitted air, namely to form an air cushion between the respective turning bar and the web running thereover.

Comparing FIGS. 3 and 5, clearly shows that in FIG. 3 the leftmost web portion 33 is placed over the rightmost web portion 32; whereas in FIG. 6 the leftmost web portion 33 is now beneath the rightmost web portion 32, which has been relocated by the turning bar pair 1, 2 to be above the leftmost web portion 33.

Shifting of the turning bars can be carried out manually by hand wheels, for example, located at the operating side 9 of the machine and coupled to the respective spindles 12, 13 and 22, 23; alternatively, it can be carried out remotely and automatically upon operation of the respective gear drive motors 14, 15, 24, 25. Upon manual re-positioning, it is desirable to provide stops or markers on the carrier bars 7, 20, 21; upon automatic re-positioning of the turning rod pairs 1, 2, it is a simple matter to supervise the number of revolutions by a rotary transducer, so that the position of the turning bars can be remotely commanded and supervised, for example from a central control console.

The turning bar pair system and the arrangement to guide web portions thereabout, can be constructed in various different ways. FIG. 7 is an illustration in which cross bar 34 is located between the two side walls 8, 9 of a printing machine or printing machine frame. The cross bar 34 is fixed and secured. Two parallel carrier elements 35, 36 are securely mounted on the cross bar 34. Parallel to the cross bar 34, a guide rail 37 is secured on the carrier elements 35, 36 and two holding blocks 38, 39 (FIG. 8) surround the guide rail 37, in jaw-like arrangement, to be axially shiftable on the guide rail 37. The holding blocks 38, 39 are formed with extensions 40, 41 on the side opposite the cross bar 34, through which a spindle 42, 43, respectively, passes. Spindles 42, 43 are parallel to the cross bar 34 and to the guide rail 37, and a respective spindle is coupled to a respective extension 40, 41 of the respective blocks 38, 39. The spindles 42, 43 are rotatable and axially fixed in the carrier elements 35, 36. A plate 44 is secured to the holding block 38, 39, extending in a direction away from the cross rods 34. A pneumatic cylinder 45, respectively, is mounted the projecting portion of the plate 44. A piston is movable in the cylinder 45, screw-connected to a plate 47 which is parallel to the lower plate 44. A pivot shaft 48, secured to the upper plate 47, passes through a vertical bore 49 of the holder block 38 and the lower plate 44. The radius of the shaft 48 is smaller than the radius of the bore. The lower side of the shaft 48 is securely coupled to a frame 51, in the side walls 52, 53 of which one of the turning bars 2 is journalled. The frame 51 is stiff and resistant to twist. A guide element 54, of dove-tail shape, is guided in a suitable recess 54 formed in the holder block 38 at the side remote from the cross rod 34. The guide element 54 is screw-connected to the upper plate 47, and can pass by the lower plate 44, see FIG. 9.

A gear motor 55, coupled to the lower or underside of the upper plate 47, drives gears 56, 57 which are located at the upper side of plate 47, to drive the pivot axis 48. Upon operation of the gear motor 55, the turning bar 2 can be pivoted by 90°.

The turning bar 1 can be pivoted by an identical structure.

Operation

Upon pressurizing the cylinder 45, the turning bar 2 is adjusted in its height level. The respective height position is predetermined and controlled by adjustable stops 64. To ensure precise guidance of the web or web portion which is to turned, and to prevent shifting or twisting of the turning bar 2, the angular position can be fine-adjusted. This fine adjustment can be done by means of hand wheels; alternatively, a position sensing element can feed back information to a control console. The pivot shaft 48 is then locked in position by a cross bolt 60 (FIG. 9) which can be energized or positioned by a short-stroke cylinder 61, to clamp the shaft 48 in the side walls of the holder blocks 38, 39, that is, within the bore 49. The short-stroke cylinder 61 can be operated pneumatically or hydraulically, and coupled to the respective block 38, 39.

Simultaneous shift of the pairs of turning bars 1, 2 by 90°, and the consequent change in height position of the respective turning bar, ensures that each one of the turning bars can carry out the respective function of, either, angle turning bar and run-out or parallel bar, or vice versa. Further, the relative height differential between the turning bars 1, 2, with respect to each other, can be changed.

The web portion to be turned and re-positioned thus does not have to be deflected in its level, and the guide roller 31, used in the embodiment of FIGS. 1–6, is not required. Yet, the exit openings for compressed air to form an air cushion will be always so positioned that an air cushion will form between the respective turning bars and the web portion guided about the turning bars.

Figure 8:
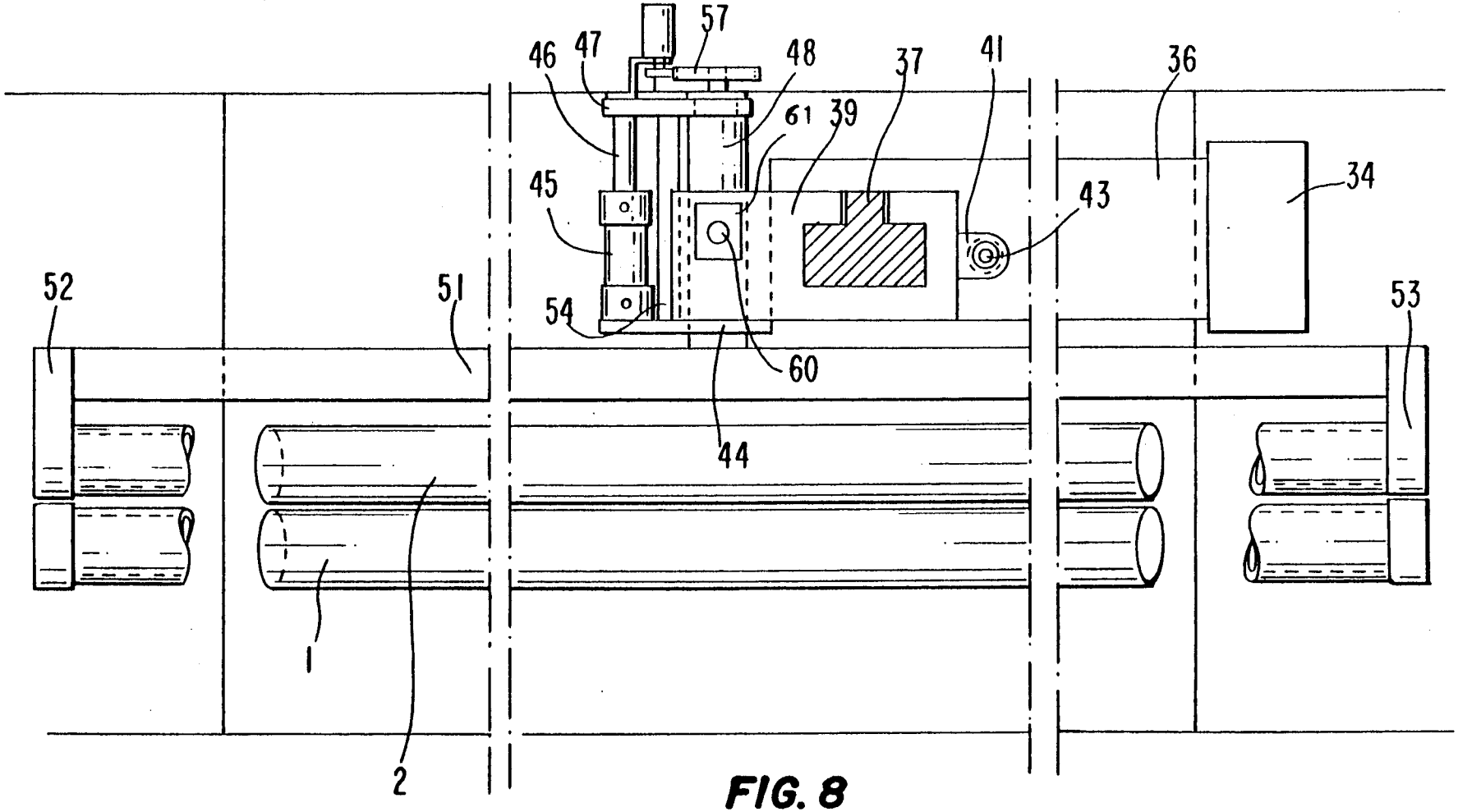
FIG. 8 is a side view of the flying retention of the turning bars of FIG. 7.
Figure 9:
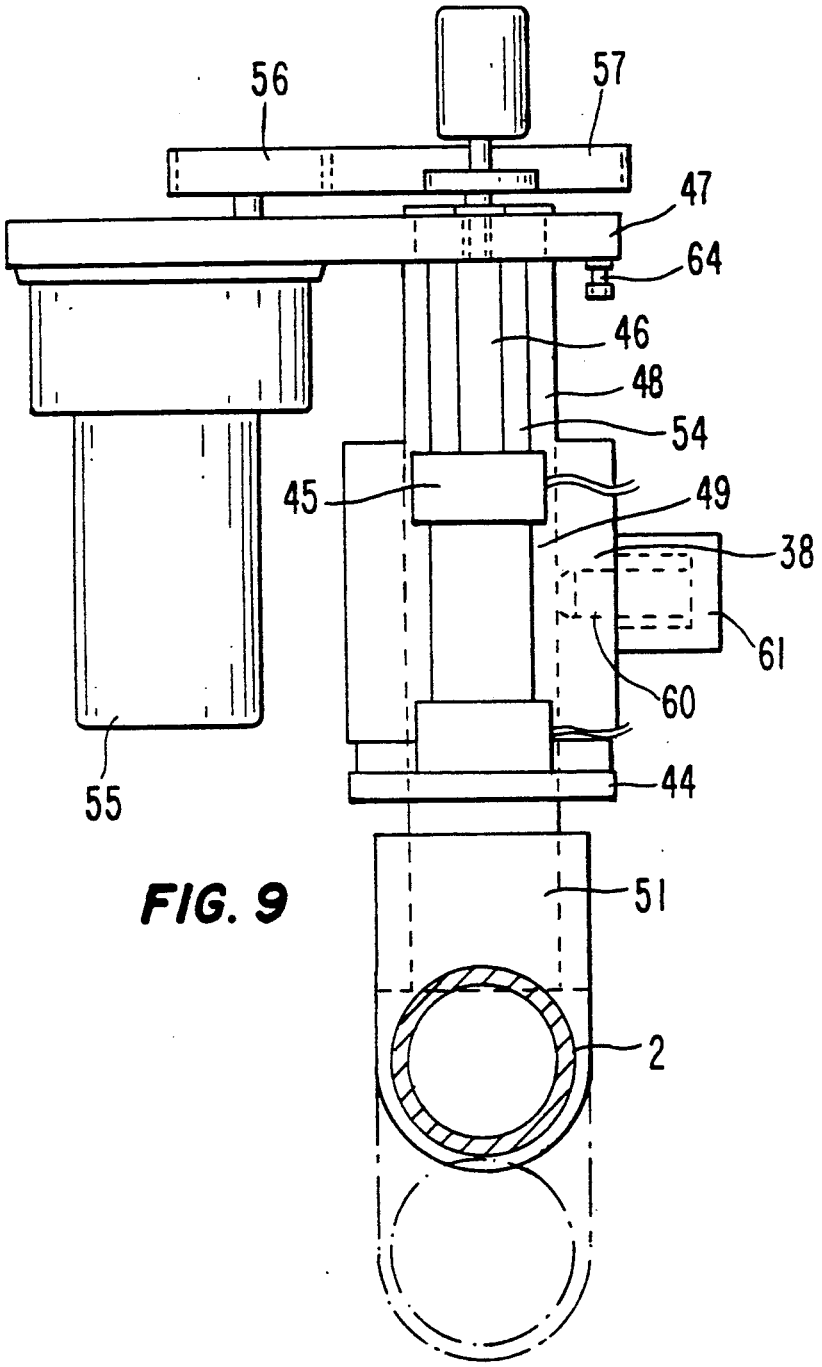
FIG. 9 is a schematic detailed view of a height arrangement of the flying retention of the turning bars, looking in a direction of the arrow A of FIG. 7.

Air supply to the turning bars 1, 2 in the embodiments of FIGS. 7–9, again, can be done by a flexible hose 58 coupled to a pivotably secured telescopic tube 59.

The arrangement of either of the embodiments has the advantage that the time-consuming and labor-intensive manual resetting of the turning bars is eliminated. Any fine adjustments can be done quickly, if required; automatic control of the turning bars is entirely feasible and by using well-known and inexpensive position sensors, can provide for accurate positioning of the turning bars from a remote control console or control unit.

Various further changes and modifications may be made. For example, the web guiding as shown in FIGS. 1–6 and specifically in FIGS. 3–6, can also be used with floatingly retained turning bars, so that a height adjustments of the turning bars can be eliminated.

Various other changes and modifications may be made, and any features described herein may be used with any of the others, within the scope of the inventive concept.

We claim:

1. Web guiding system for guiding two moving web portions (32, 33) arriving adjacent each other into superposed position in which the relative position of the superposed web portions with respect to each other is freely selectable, having two hollow turning bar means (1, 2) transversely spaced with respect to the plane of the arriving web portion, said hollow turning bar means being formed with spaced radially aligned apertures (a, b) positioned parallel to and radially spaced with respect to the plane of one of the arriving web portions;

guide means (29, 30, 31; 45, 46) for guiding said web portions (32, 33) towards said two hollow turning bar means (1, 2) to place said web portions, in operation of the system, selectively in a path in which said one of the web portions is partly wrapped or looped about said turning bar means, and wherein said radially aligned apertures (a, b) are located in a plane facing said one partly wrapped or looped web portion;

means (26, 27, 28; 58) for introducing pressurized air into the turning bar means (1, 2) to float said one web portion on the surface of the turning bar means about which it is being partly wrapped or looped by forming an air cushion between said turning bar means and the respective web portion; and means for positioning the turning bar means (1, 2) selectively in a first turning position or a second turning position rotated 90° with respect to said first turning position; and comprising means for ensuring presence of the air cushion between the turning bar means and said one web portion regardless of the turning position of the turning bar means, wherein said guide means (29, 30, 31: 45, 46) includes a web portion supply cylinder or roller means (29) and web portion guide roller means (30, 31) for selectively controlling the path of travel of said one web portion with respect to the level of the turning bar means about which said one web portion is first passed, and the direction of the looping path about said first-passed or looped-about turning bar means.

2. The system of claim 1, wherein said guide means (29, 31) selectively guides said one web portion to partly wrap or loop first about either one or the other of said two transversely spaced turning bar means (1, 2).

3. The system of claim 2, wherein said guide means (29, 31) guides said web portion (33) about the first-passed or looped-about turning bar (2) of the two turning bar means (1, 2) and then about the second turning bar means (1) of the two turning bar means, and then defining a run-off portion (RA), and wherein the major planes of the web portion being guided to the first turning bar means (2) and of the run-off portion of the turning bar means are parallel.

4. The system of claim 1, wherein said web portion supply cylinder or roller means (29) comprises a cutting or slitting roller or cylinder (29).

5. The system of claim 1, wherein said means for controlling the path of travel of said one web portion with respect to the level of the turning bar means comprises a frame (8, 9, 34, 35, 36, 37);

means (48, 52, 53) for pivotably securing said turning bar means (1, 2) on said frame while permitting pivotal movement of said two turning bars about an axis transverse to said turning bars; and means for positioning the level of said pivotable securing means, and hence of said turning bars.

6. The system of claim 5, wherein said means for pivotably securing said turning bar means are individually independently height or level adjustable.

7. The system of claim 5, wherein said means for pivotably securing said turning bar means comprises a pair of holder or support blocks (38, 39), one for each turning bar means; and wherein said height adjustable means comprises a fluid-operated cylinder element—piston element arrangement, one for each holder or support block (38, 39), one of said elements being secured to the respective holder or support block, and the other element being secured to said means (48) for pivotably securing said turning bar means in said frame.

8. The system of claim 7, wherein said means for pivotably securing said turning bar means in said frame includes a pivot shaft (48) and means (44; 49) for guiding said shaft in a path perpendicular to the axis of the respective turning bar means.

9. The system of claim 1, wherein said web portion supply roller means (29) comprises a cutting or slitting cylinder or roller (29) having the web (W) passed thereover, and slitting said web into said two web portions (32, 33), said web (W) forming a freshly printed paper web.

* * * * *